US009145700B2

(12) United States Patent
Zhu

(10) Patent No.: US 9,145,700 B2
(45) Date of Patent: Sep. 29, 2015

(54) THREE-DIMENSIONAL PARKING GARAGE

(75) Inventor: Jianhua Zhu, Ningbo (CN)

(73) Assignee: Ningbo Bangda Intelligent Parking System Co., Ltd., Ningbo (CN)

( * ) Notice: Subject to any disclaimer, the term of this patent is extended or adjusted under 35 U.S.C. 154(b) by 539 days.

(21) Appl. No.: 13/807,854

(22) PCT Filed: Aug. 30, 2010

(86) PCT No.: PCT/CN2010/001311

§ 371 (c)(1),
(2), (4) Date: Dec. 31, 2012

(87) PCT Pub. No.: WO2012/003607

PCT Pub. Date: Jan. 12, 2012

(65) Prior Publication Data

US 2013/0097960 A1 Apr. 25, 2013

(30) Foreign Application Priority Data

Jul. 9, 2010 (CN) ..... 2010 1 0226911

(51) Int. Cl.
*E04H 6/08* (2006.01)
*E04H 6/22* (2006.01)
*E04B 1/19* (2006.01)

(52) U.S. Cl.
CPC .. *E04H 6/08* (2013.01); *E04B 1/19* (2013.01); *E04H 6/225* (2013.01)

(58) Field of Classification Search
CPC ..... E04H 6/225; E04H 6/08; E04B 1/16
USPC ..... 52/79.1, 840, 843, 850, 851, 845, 848; 414/227, 233, 239, 240
See application file for complete search history.

(56) References Cited

U.S. PATENT DOCUMENTS

| | | | | |
|---|---|---|---|---|
| 2,626,718 | A * | 1/1953 | Weber | 414/240 |
| 3,155,246 | A * | 11/1964 | Baume | 414/286 |
| 5,505,573 | A * | 4/1996 | Han | 414/254 |
| 6,065,921 | A * | 5/2000 | Van Dijk | 414/259 |
| 8,075,237 | B2 * | 12/2011 | Webster et al. | 414/239 |
| 8,812,148 | B2 * | 8/2014 | Kharkover et al. | 700/218 |
| 8,939,426 | B2 * | 1/2015 | Zhu | 248/676 |
| 2002/0146305 | A1 * | 10/2002 | Haag | 414/228 |
| 2014/0294543 | A1 * | 10/2014 | Jarvinen et al. | 414/227 |

FOREIGN PATENT DOCUMENTS

| | | | | |
|---|---|---|---|---|
| CN | WO 2012/003607 | * | 12/2012 | E04C 6/08 |
| JP | H08158687 | * | 6/1996 | E04H 6/18 |

* cited by examiner

*Primary Examiner* — Kaitlin Joerger
(74) *Attorney, Agent, or Firm* — Wang Law Firm, Inc.; Li K. Wang; Stephen Hsu

(57) ABSTRACT

A three-dimensional parking garage has a three-dimensional frame and multiple vehicle carriers. Each vehicle carrier has a bottom frame, and the three-dimensional frame comprises a front transverse beam, multiple front columns, multiple longitudinal crossbeams, and multiple rear columns; each front transverse beam, front column, longitudinal crossbeam, and rear columns are formed by two nested components; the vehicle carrier further has an accessorial frame, a first vehicle plate and a second vehicle plate. The frame of the three-dimensional parking garage can adopt thinner plates as raw materials. The vehicle plate used for vehicle parking of the parking garage is disposed between the side beam of the bottom frame and the accessorial frame, and the accessorial frame with a smaller span length, so the material is thinner and steel with 1.6 mm thickness can be used, and the materials can be significantly saved and costs can be greatly reduced.

8 Claims, 8 Drawing Sheets

THREE-DIMENSIONAL PARKING GARAGE

RELATE APPLICATIONS

This application is a national phase entrance of and claims benefit to PCT Application for Three-dimensional Parking Garage and the Application thereof, PCT/CN2010/001311, filed on Aug. 30, 2010, which claims benefit to Chinese Patent Application 201010226911.8, filed on Jul. 9, 2010. The specifications of both applications are incorporated here by this reference.

FIELD OF THE INVENTION

The present invention relates to a three-dimensional parking garage.

DESCRIPTION OF THE PRIOR ART

Owing to economic development, urban population and the number of vehicles grow year by year and the problem of parking in the urban area needs to be solved. The traditional single-floor and plane parking garages occupy a large number of precious land resources and cannot meet needs indefinitely.

The modern advanced automatic three-dimensional parking garage is a three-dimensional parking garage with multiple planes. The three-dimensional parking garage has the single-floor plane parking garage as the core and changes the spatial positions of the parking lots by microcomputer so as to realize the transfer from space to plane of the parking lot, thus achieving the function of parking in multi-floor plane. However, the beam-column members of the existing three-dimensional parking garage, such as various kinds of bearing bridging beams of the frame, connecting column and so on, adopt standard sections. The standard sections purchased in the market directly are often in simple structure and generally also need to have the through-holes or grooves opened so as to fit to other equipment and connecting structures. Therefore, the standard sections purchased from the market can not be used as the goods shelf or the bridging beam or column of the garage frame, while the processes like cutting and drilling in the standard sections need manual lineation and lofting, which not only leads to the low processing speed, low efficiency, great difficulties in ensuring the geometric accuracy and geometric tolerance of the holes and grooves but also results in the waste of the raw materials and low material utilization.

In addition, the vehicle carrier of the existing three-dimensional parking garages is mostly in frame structure which generally comprises a left side beam, a right side beam and a bridging beam disposed between the left beam and the right beam. The integrated vehicle plate is arranged between the left side beam and the right side beam, and the vehicles park on the vehicle plates. The disadvantage of vehicle plate is that the vehicle plate is of a great span length. To guarantee the carrying capacity, the vehicle plate can not be too thin and generally be made of 2 mm steel plate, thus the materials needed for the vehicle plate shall be relatively thick with a lot of materials consumed and high cost. Moreover, no guiding beams are installed in existing vehicle plates in general. When driving into the parking lots of the three-dimensional parking garage, it is very easy for the vehicles to deviate from the middle straight-line direction, which leads to the condition of inclined parking on the vehicle carrier and brings inconvenience when the vehicles drives away from the vehicle carrier.

SUMMARY OF THE INVENTION

It is an object of the present invention to provide a three-dimensional parking garage with stronger and more rigid transverse beams and columns as well as lighter vehicle carrier, which can reduce the production cost and the consumption of raw material.

For achieving the above stated object, the three-dimensional parking garage comprises a three-dimensional frame composed of a front traverse beam, a plurality of front columns, a plurality of longitudinal crossbeams, and a plurality of rear columns, each of the front transverse beam, the front columns, and the longitudinal crossbeams is formed by a first component nested with a second component, the first component and the second component having the same shape and size, each of the rear columns is formed by a third component nested with a forth component, the third component and the forth component having the same shape and size; and a plurality of vehicle carriers mounted on the three-dimensional frame, each vehicle carrier comprises a bottom frame having a length and composed of a left beam, a right beam substantially parallel to the left beam and a bridging beam connecting the left beam and the right beam, wherein, each vehicle carrier further comprises an accessorial frame, which is disposed along the length of the bottom frame and located in a center of the bottom frame and parallel to the left beam and the right beam, a first vehicle plate, with a left side and a right side, is placed between the accessorial frame and the left beam, and a second vehicle plate, with a left side and a right side, is placed between the accessorial frame and the right beam, each of the left beam and the right beam has a first inner wall and a second inner wall, the left side of the first vehicle plate is perpendicularly mounted to the first inner wall of the left beam, the right side of the first vehicle plate is mounted to the accessorial frame, while, the right side of the second vehicle plate is perpendicularly mounted to the second inner wall of the right beam, the left side of the second vehicle plate is mounted to the accessorial frame.

As a preference, the front transverse beam, the front columns and the longitudinal crossbeam are formed by a rectangular column body with substantially rectangular cross sections, and the rectangular column body comprises the first component and the second component, each component formed through cold rolling with uniform cross sections; the first component comprises an upper first traverse edge and a lower first traverse edge arranged in parallel, a first vertical edge connecting the upper first traverse edge to the lower first traverse edge, a first inserting edge folding and extending vertically and upwardly from the lower first traverse edge, and a first covering edge folding and extending vertically and downwardly from the upper first traverse edge oppositely to the first inserting edge; the second component comprises an upper second traverse edge and a lower second traverse edge arranged in parallel, a second vertical edge connecting the upper second traverse edge to the lower second traverse edge, a second inserting edge folding and extending vertically and upwardly from the upper second traverse edge, and a second covering edge folding and extending vertically and downwardly from the lower second traverse edge oppositely to the second inserting edge; and the two first traverse edges of the first component respectively touch one of two second traverse edges of the second component, the first inserting edge touches the inner surface of the second vertical edge of the second component, the first covering edge touches the outer surface of the second vertical edge of the second component, the second inserting edge touches the inner surface of the first vertical edge of the first component, and the second covering edge touches the outer surface of the first vertical edge of the first component. Owing to that the first component and the second component are with uniform cross sections, it is more convenient for packing, storing and transporting. Meanwhile, the packing space as well as the efficiency of storing and transporting can be improved so as to reduce the cost.

In consideration of that the rear column is used for installing the machinery and electronic components such as the elevator mechanism, motors, chains, etc. As a preference, each rear column is formed by an I-shaped column body with a hollow-I-shaped cross section, and the I-shaped column body comprises the third component and the forth component, each component formed through cold rolling with uniform cross sections; the third component comprises an upper third traverse edge and a lower third traverse edge arranged in parallel, a third vertical edge connecting the upper third traverse edge with the lower third traverse edge, a third L-shaped edge folding and extending vertically and outwardly from the third vertical edge and connecting with the upper third traverse edge, a forth L-shaped edge folding and extending vertically and outwardly from the third vertical edge and connecting with the lower third traverse edge, and a third inserting edge folding and extending vertically and upwardly from the lower third traverse edge, a third covering edge folding and extending vertically and downwardly from the upper third traverse edge oppositely to the third inserting edge; the forth component comprises an upper forth traverse edge and a lower forth traverse edge arranged in parallel, a forth vertical edge connecting the upper forth traverse edge with the lower forth traverse edge, a fifth L-shaped edge folding and extending vertically and outwardly from the forth vertical edge and connecting with the upper forth traverse edge, a sixth L-shaped edge folding and extending vertically and outwardly from the forth vertical edge and connecting with the lower forth traverse edge, and a forth inserting edge folding and extending vertically and downwardly from the upper forth traverse edge, a second covering edge folding and extending vertically and upwardly from the lower forth traverse edge oppositely to the forth inserting edge; the two third traverse edges of the third component respectively touch one of two forth traverse edges of the forth component, the third inserting edge touches the inner surface of the sixth L-shaped edge, the third covering edge touches the outer surface of the fifth L-shaped edge, the forth inserting edge touches the inner surface of the third L-shaped edge, and the forth covering edge touches the outer surface of the forth L-shaped edge.

In order to increase the strength and rigidity of the accessorial frame, the plane frame structure is adopted preferably. As the preference, the accessorial frame further comprises two guiding beams, a front cross rail, and a rear cross rail, the front cross rail and the rear cross rail connecting two guiding beams, and a plurality of intermediate cross rails, placed between the front cross rail and the rear cross rail, connecting the two guiding beams.

In order to ensure that the accessorial frame matches with the bottom frame well when in installation, as a preference, the bottom frame comprises a front bridging beam, a middle bridging beam, and a rear bridging beam; the front bridging beam has a front side with a slope and two ends connected to the left beam and the right beam, both ends of the rear bridging beam connected to the rear ends of the left beam and the right beam, the middle bridging beam is located between the front bridging beam and the rear bridging beam, and both ends of the middle bridging beam are connected to the middle of the left beam and the right beam; each guiding beam is provided with a recess for engaging the middle bridging beam. Therefore, the recesses opened on the guiding beams for the accessorial frame can match with the middle bridging beam of bottom frame, so that the bottom surface of the accessorial frame can be in parallel with that of the bottom frame, thus the accessorial frame and bottom frame can integrate more closely and it is more convenient and reliable to fix and install.

In order to avoid the scraping between the inner side of the vehicle tires and the seamed edge of the accessorial frame when the vehicle drives into the parking lot, preferably, the front cross rail and two guiding beams forming two joint corners, each joint corner being formed with a first inclined cutting surface and each inclined cutting surface is covered with an inner protecting seal head. The inner protecting seal head can be a plastic component made by injection molding, and can be directly covered on the first inclined cutting surfaces. The inner protecting seal head can protect the vehicle tires and is easy to be installed or taken down.

In order to keep the cleanness of the accessorial frame and prevent the engine oil or dust from the chassis of the vehicles parked on the vehicle upper carrier dripping or traveling onto the vehicle parked on the lower vehicle carrier through the gap of the accessorial frame, preferably, a grease baffle is provided on the accessorial frame, and the grease baffle has a plurality of grooves. The trapezi-form groove provides the functions of accumulating and guiding, and the grease baffle can be cleaned conveniently.

In consideration of protecting the outer side of the vehicle tires, as a preference, one second inclined cutting surface is formed at a front end of each of the left beam and the right beam, each second inclined cutting surface is covered with an outer protecting seal head.

Compared with the prior art, in this invention, firstly, each transverse beam and column of the three-dimensional parking garage respectively formed by two nested components which are composed of the first component and the second component with the same shape and size overlapped and embraced with each other to form a column body. Owing to that the first component and the second component can adopt thinner plates as the raw materials to be cold rolled and formed, the dimensions of the sections can be guaranteed, which will reduce the raw material consumption and the production cost to a great extent, while each beam is in nested structure which is composed of the first component and the second component results in great improvement in the intensity and rigidity of the product.

Secondly, an accessorial frame is disposed on the bottom frame of the vehicle carrier. The vehicle plate used for vehicle parking is disposed between the side beam of the bottom frame and the accessorial frame. The accessorial frame with a smaller span length, so the material needed is thinner and the steel with 1.6 mm thickness can be used and is strong enough. Accordingly, the weight of the vehicle carrier can be reduced by a quarter of the existing vehicle carrier, the materials can be significantly saved and the costs can be greatly reduced.

Thirdly, the vehicle carrier comes into a whole device through the connection of the accessorial frame, the vehicle plate and the bottom frame. As the accessorial frame is located in the center of the bottom frame, the whole rigidity of the vehicle carrier is improved markedly, and the carrying capacity of the vehicle carrier is also improved.

Additionally, the accessorial frame also plays a role in guiding the vehicles, that is, when the vehicle is running to the parking space, the left and right tires of the vehicle can respectively move along the both sides beams of the accessorial frame, to avoid the vehicle shifting on the direction, and ensure the vehicle to park in the correct orientation, and make the departure of the vehicle more convenient.

DETAILED DESCRIPTION OF THE PREFERRED EMBODIMENT

To enable a further understanding of the innovative and technological content of the invention herein, refer to the detailed description of the invention and the accompanying drawings below:

As shown in FIG. 1~FIG. 14, the three-dimensional parking garage of the present invention comprises a three-dimensional frame and multiple vehicle carriers E. The vehicle carrier comprises transversely moving vehicle carrier and vertically lifting vehicle carrier. The transversely moving vehicle carrier is disposed at the bottom of the three-dimensional frame and can only slip laterally along the guide rail F at the bottom of the three-dimensional frame; all the vehicle carriers above the transversely moving vehicle carrier are vertically lifting vehicle carriers, which can not only be distributed along the spatial vertical direction but also the lateral direction in the same floor. In addition, the vertically lifting vehicle carrier can move up and down along the vertical direction of the three-dimensional frame under the control of lifting devices and also move along the lateral direction in the same floor.

The three-dimensional frame comprises a front transverse beam A disposed laterally, two front columns B disposed vertically, four longitudinal crossbeams C disposed lengthways and four rear columns D disposed vertically, wherein, each front transverse beam A, front column B, and longitudinal crossbeam C are respectively formed by a first component nested with a second component, the first component and the second component have the same shape and size, each of the rear columns is formed by a third component 1' nested with a forth component 2', the third component 1' and the forth component 2' have the same shape and size, moreover, all these four components are formed through cold rolling with uniform cross sections.

Figure 1:
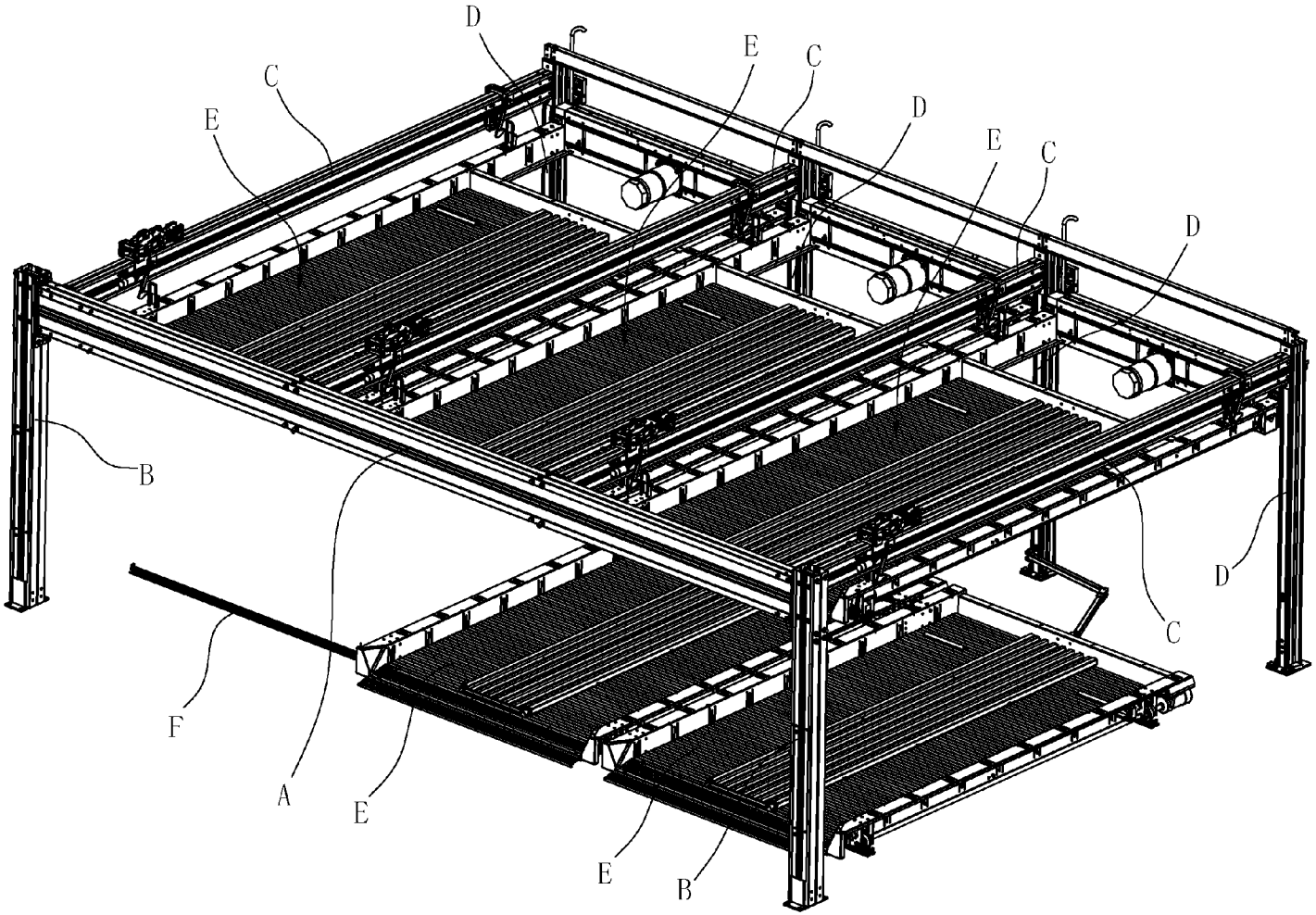
FIG. 1 is a perspective view of a three-dimensional parking garage in accordance with an embodiment of the present invention.
Figure 4:
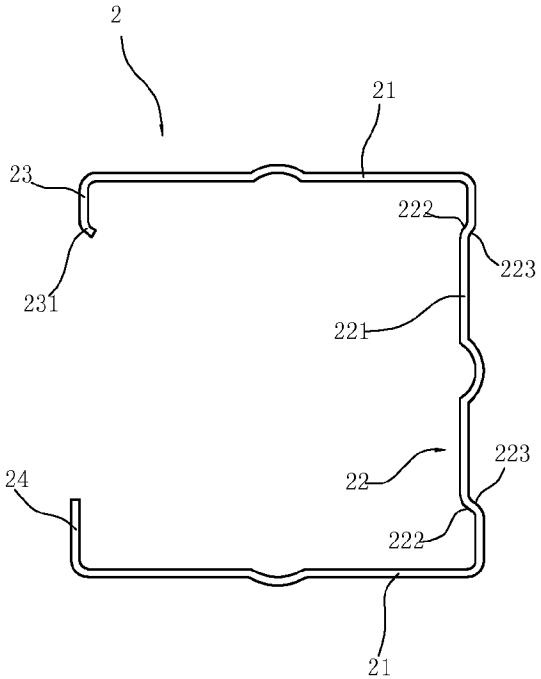
FIG. 4 is a sectional view of the second component shown in FIG. 2.
Figure 3:
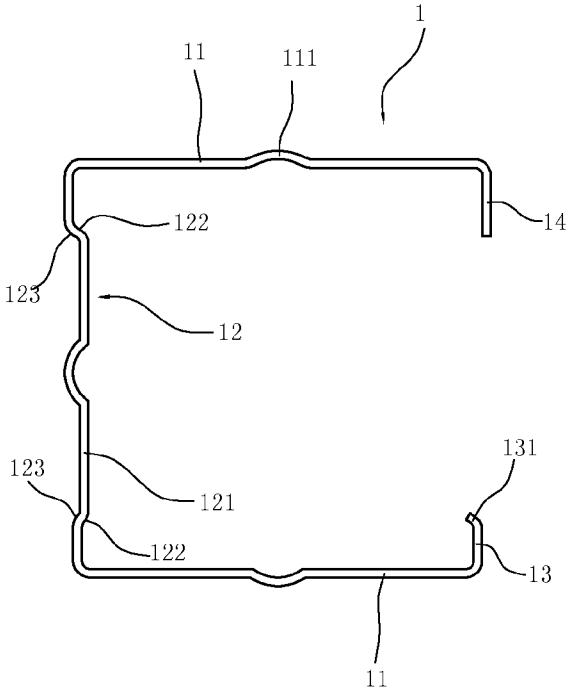
FIG. 3 is a sectional view of the first component shown in FIG. 2.
Figure 2:
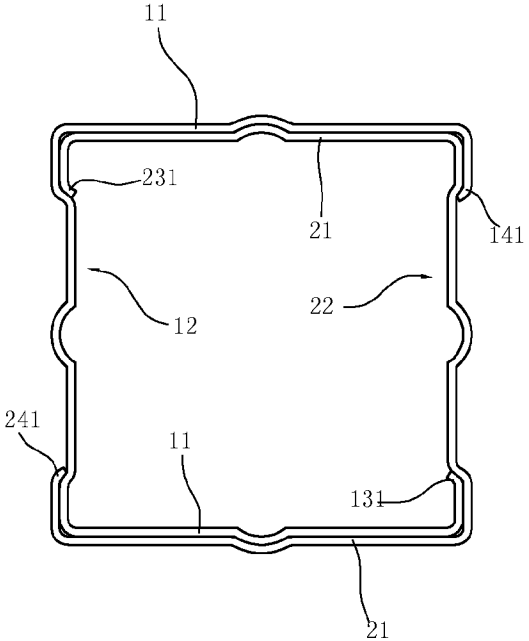
FIG. 2 is a sectional view of the front transverse beam in accordance with the embodiment of the present invention.

FIG. 2~FIG. 4 are sectional views of the front transverse beam A in accordance with the embodiment of the present invention. The cross section of each front transverse beam A is substantially in square and formed by the first component 1 and the second component 2, after being manufactured, the second component 2 is rotated 180 degree and overlapped and embraced with the first component 1 to form a column body. The first component 1 comprises an upper first traverse edge 11 and a lower first traverse edge 11 substantially parallel to each other, a first vertical edge 12 connecting the upper first traverse edge to the lower first traverse edge, a first inserting edge 13 folding and extending vertically and upwardly from the lower first traverse edge 11, and a first covering edge 14 folding and extending vertically and downwardly from the upper first traverse edge 11 oppositely to the first inserting edge; the first component 1 forms a first buckling part 131 folded inwardly at one end of the first inserting edge 13, and a first reinforcement bar 121 concaved inwardly is formed on the first vertical edge 12 of the first component 1; the second component 2 comprises an upper second traverse edge 21 and a lower second traverse edge 21 substantially parallel to each other, a second vertical edge 22 connecting the upper second traverse edge to the lower second traverse edge, a second inserting edge 23 folding and extending vertically and upwardly from the upper second traverse edge 21, and a second covering edge 24 folding and extending vertically and downwardly from the lower second traverse edge 21 oppositely to the second inserting edge; the second component 2 forms a second buckling part 231 at one end of the second inserting edge 23, and a second reinforcement bar 221 concaved inwardly is formed on the second vertical edge 22 of the second component 2.

During the installation, the first component 1 and second component 2 are nested with each other. The two first traverse edges 11 of the first component 1 respectively completely touch one of two second traverse edges 21 of the second component 2, the first inserting edge 13 completely touches the inner surface of the second vertical edge 22 of the second component 2, the first covering edge 14 completely touches the outer surface of the second vertical edge 22 of the second component 2, and the first buckling part 131 touches a first inner convex part 122 of the first reinforcement bar 121; the second inserting edge 23 completely touches the inner surface of the first vertical edge 12 of the first component 1, and the second covering edge 24 completely touches the outer surface of the first vertical edge 12 of the first component 1, and the second buckling part 231 touches a second inner convex part 222 of the second reinforcement bar 221. The above stated complete touching manner guarantees the limitation between the first component 1 and the second component 2 along the traverse direction.

To avoid the separation between the first component 1 and the second component 2, when the first component 1 and the second component 2 are nested combined, the first component 1 forms a third buckling part 141 folded inwardly at one end of the first covering edge 14, and the second component 2 forms a fourth buckling part 241 folded inwardly at one end of the second covering edge 24, so that the third buckling part 141 touches the outer concave part 123 of the first reinforcement bar 121 and the fourth buckling part 241 touches an outer concave part 223 of the second reinforcement bar 221. The above stated touching manner guarantees the limitation between the first component 1 and the second component 2 along the vertical direction.

To increase strength and rigidity of the components (profiles) after being nested, the first vertical edge 12 is formed with a first groove 124 with the C-shaped cross section on the first reinforcement bar 121. The opening direction of the first groove 124 is consistent with that of the first component 1. The second vertical edge 22 also is formed with a second groove 224 on the second reinforcement bar 221, the opening direction of which is consistent with that of the second component 2; to further increase the section strength, a first convex bar 111 is provided on the first traverse edge 11 and a second convex bar 211 is also provided on the second traverse edge 21.

Figure 7:
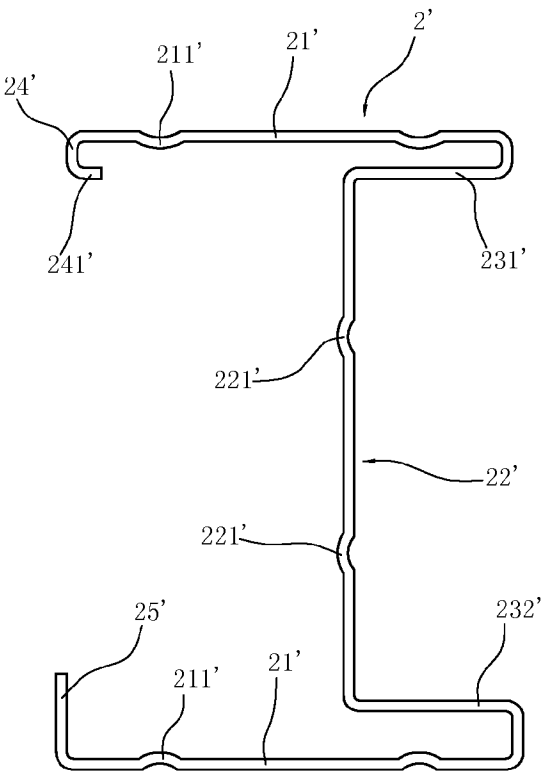
FIG. 7 is a sectional view of the forth component shown in FIG. 5.
Figure 6:
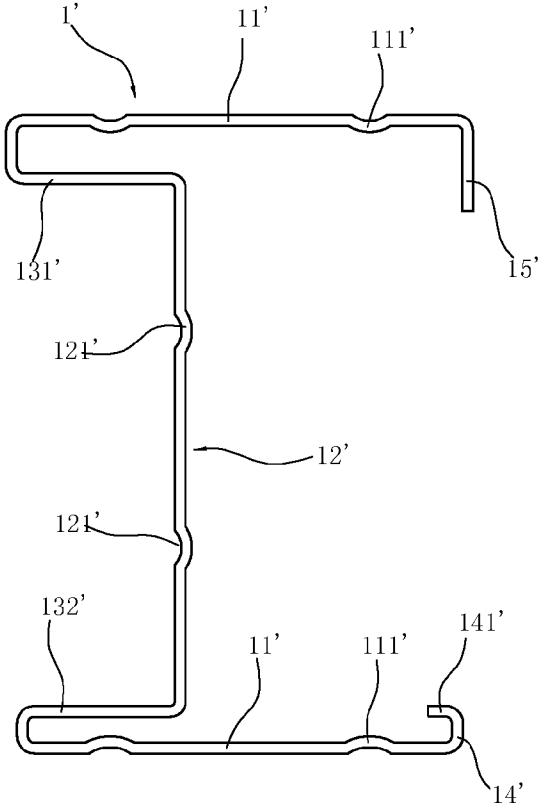
FIG. 6 is a sectional view of the third component shown in FIG. 5.
Figure 5:
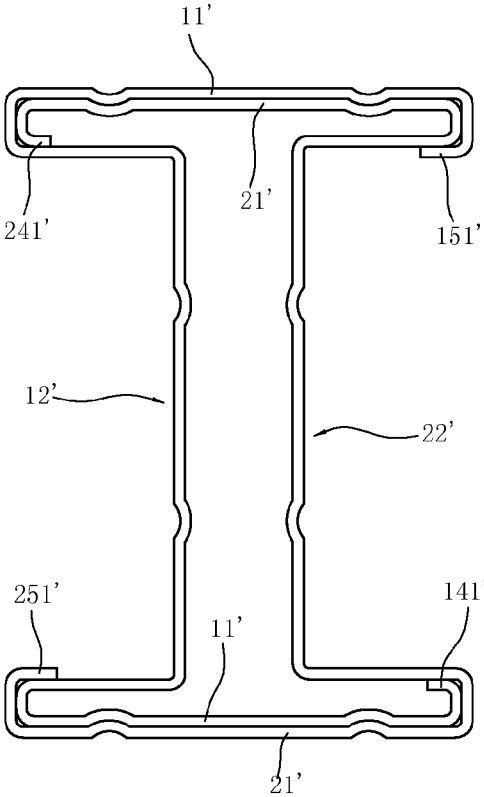
FIG. 5 is a sectional view of the rear column in accordance with the embodiment of the present invention.

FIG. 5~FIG. 7 are the sectional views of the rear column D in accordance with the embodiment of the present invention. In consideration of that machinery and electrical equipment like elevator mechanism, motors and chains need to be mounted on the rear column D, the rear column is a I-shaped column body with a hollow-I-shaped cross section and formed by the third component 1' and the forth component 2' overlapped and embraced with each other.

The third component 1' comprises an upper third traverse edge 11' and a lower third traverse edge 11' substantially parallel to each other, a third vertical edge 12' connecting the upper third traverse edge with the lower third traverse edge, a third L-shaped edge 131' folding and extending vertically and outwardly from the third vertical edge 12' and connecting with the upper third traverse edge 11', a forth L-shaped edge 132' folding and extending vertically and outwardly from the third vertical edge 12' and connecting with the lower third traverse edge 11'. The left half I-shaped column body is formed by the two third traverse edges 11', the third L-shaped edge 131', the forth L-shaped edge 132' and the third vertical edge 12'. In addition, a third inserting edge 14' folding and extending vertically and upwardly from the lower third traverse edge 11', a third covering edge 15' folding and extending vertically and downwardly from the upper third traverse edge 11' oppositely to the third inserting edge, and the third component 1' forms a third buckling part 141' folded inward at the end of the third inserting edge 14; the forth component 2' comprises an upper forth traverse edge and a lower forth traverse edge 21' substantially parallel to each other, a forth vertical edge 22' connecting the upper forth traverse edge with the lower forth traverse edge, a fifth L-shaped edge 231' folding and extending vertically and outwardly from the forth vertical edge 22' and connecting with the upper forth traverse edge 21', a sixth L-shaped edge 232' folding and extending vertically and outwardly from the forth vertical edge 22' and connecting with the lower forth traverse edge 21'. The right half I-shaped column body is formed by two forth traverse edges 21', the fifth L-shaped edge 231', the sixth L-shaped edge 232' and the forth vertical edge 22'. In addition, a forth inserting edge 24' folding and extending vertically and downwardly from the upper forth traverse edge 21', a second covering edge 25' folding and extending vertically and upwardly from the lower forth traverse edge 21' oppositely to the forth inserting edge.

To increase section strength and rigidity after being nested, the third vertical edge 12' also is formed with a third groove 121' mounted along the length direction of the I-shaped upright column; the forth vertical edge 22' is formed with a forth groove 221' mounted along the length direction of the I-shaped upright column; the third convex bar is mounted on the third traverse edge 11' along the length direction of the I-shaped upright column, and a forth convex bar 211' is mounted on the forth traverse edge 21' along the length direction of the I-shaped upright column.

The nesting method of the third component 1' and the forth component 2' of the rear column D is the same with that of the front transverse beam A, and after the third component 1' and the forth component 2' are nested with each other, the third component 1' is formed with a fifth buckling part 151' folded inwardly at the end of the third covering edge 15', which touches the outer surface of the fifth L-shaped edge 231' of the forth component 2'. The fifth buckling part 151' touches the exterior angle of the fifth L-shaped edge 231'. The forth component 2' also is formed with a sixth buckling part 251' folded inwardly at the end of the forth covering edge 25', which touches the outer surface of the forth L-shaped edge 132' of the third component 1. The sixth buckling part 251' touches the exterior angle of the forth L-shaped edge 132'.

Figure 9:
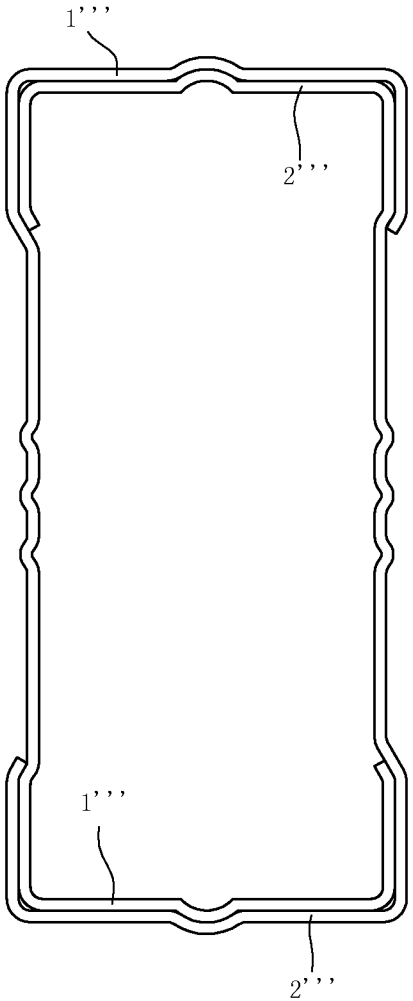
FIG. 9 is a sectional view of the front transverse beam in accordance with the embodiment of the present invention.
Figure 8:
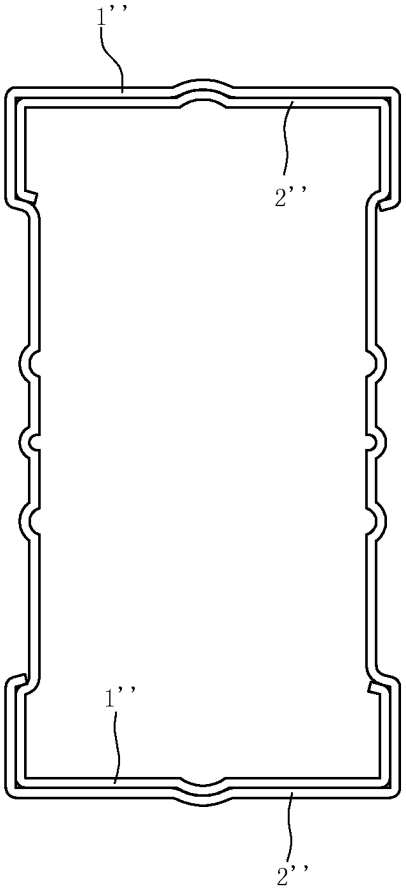
FIG. 8 is a sectional view of the front column in accordance with the embodiment of the present invention.
Figure 10:
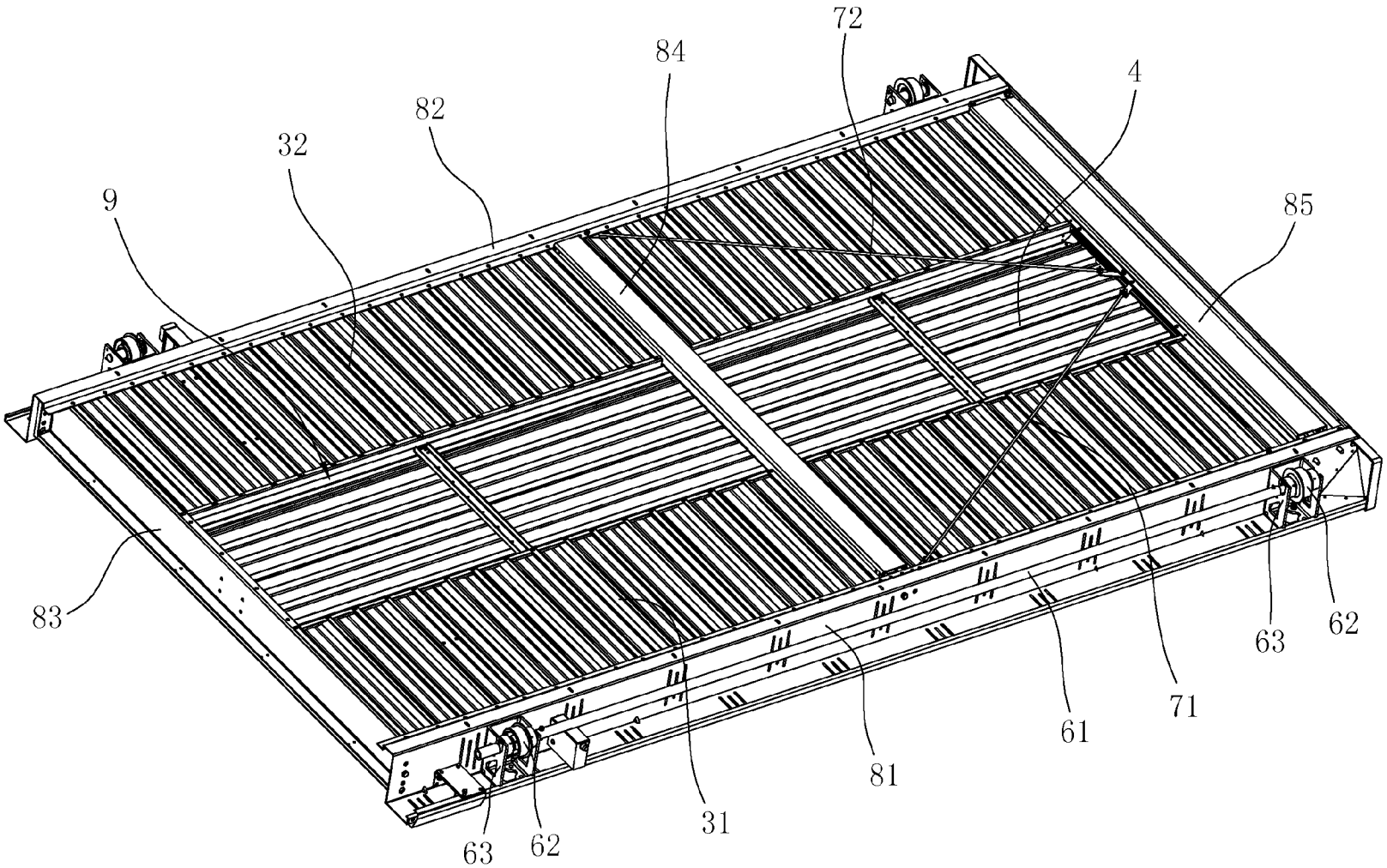
FIG. 10 is a perspective view of the vehicle carrier in accordance with the embodiment of the present invention (see from the back side).
Figure 11:
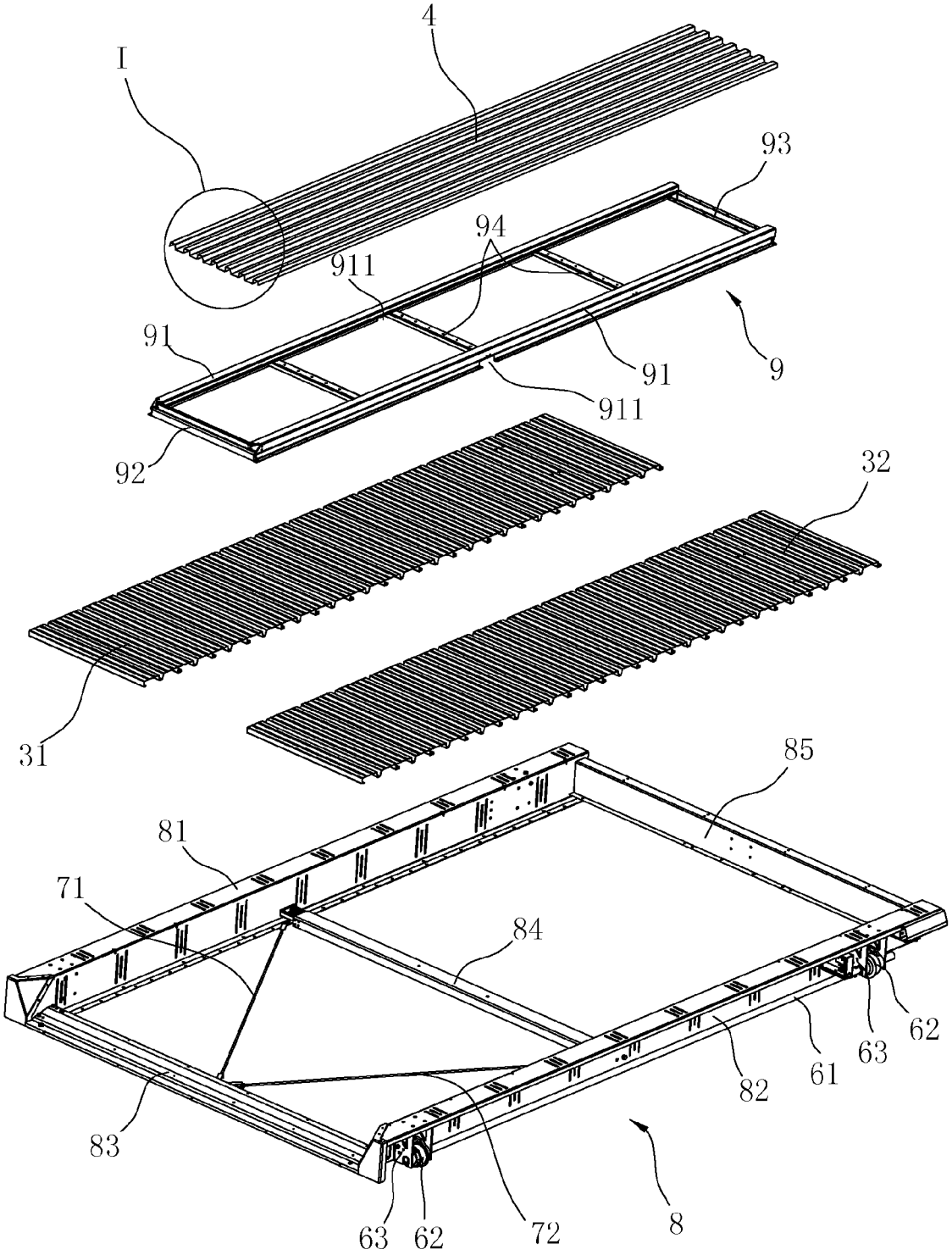
FIG. 11 is an exploded perspective view of the vehicle carrier in accordance with the embodiment of the present invention.
Figure 12:
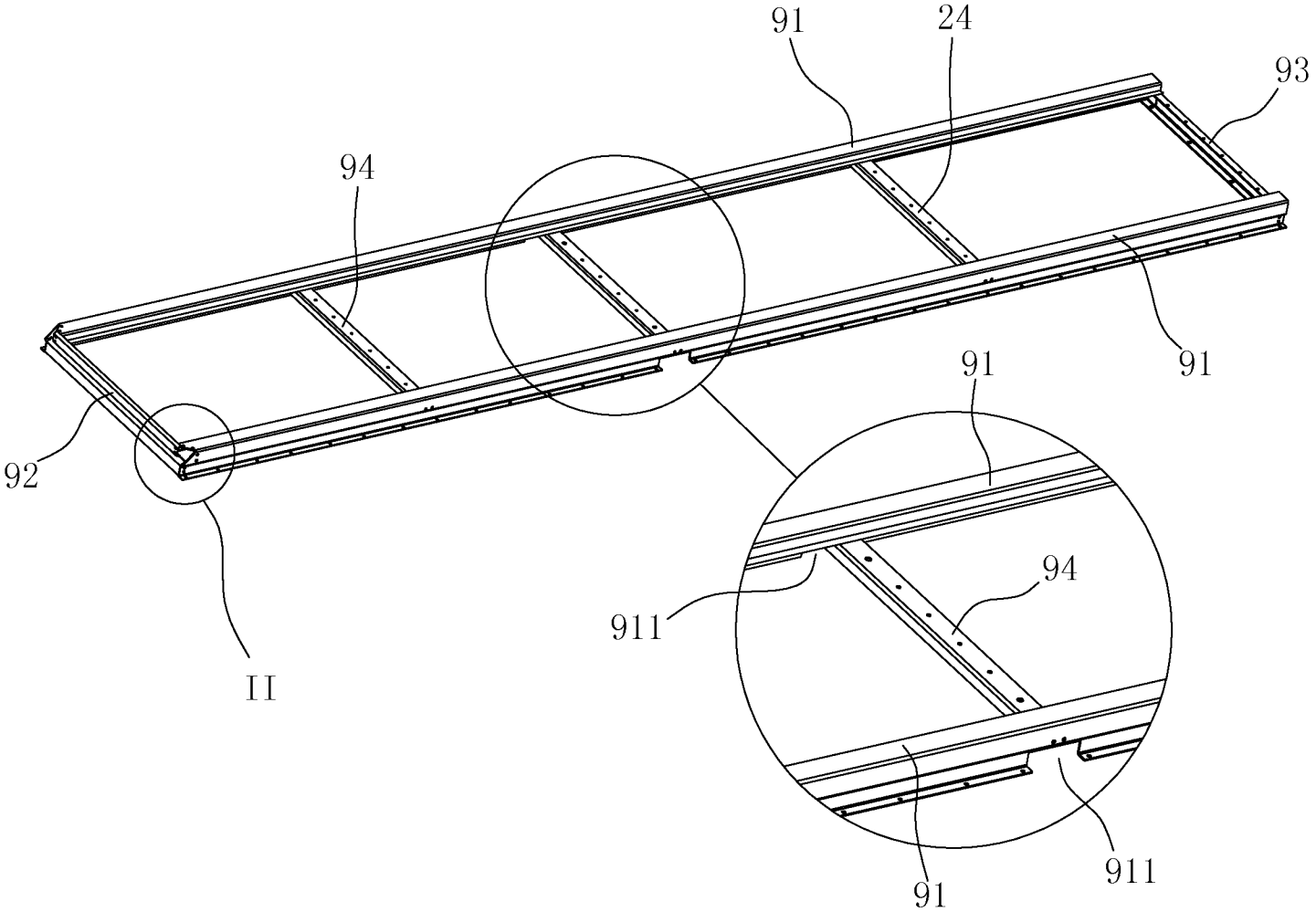
FIG. 12 is a perspective view of the accessorial frame of the vehicle carrier shown in FIG. 10.
Figure 13:
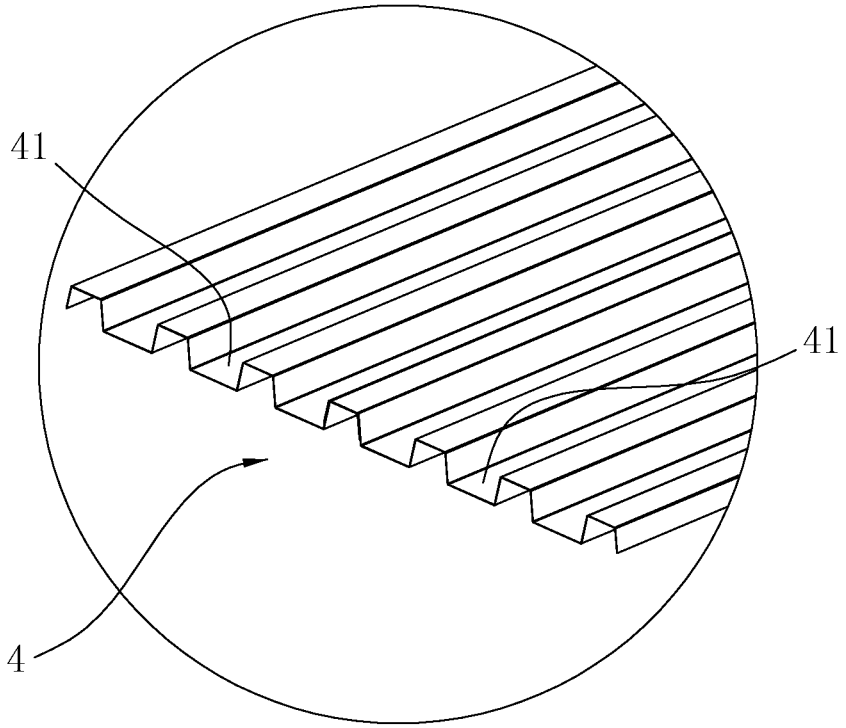
FIG. 13 is an enlarged view of part-I shown in FIG. 11.
Figure 14:
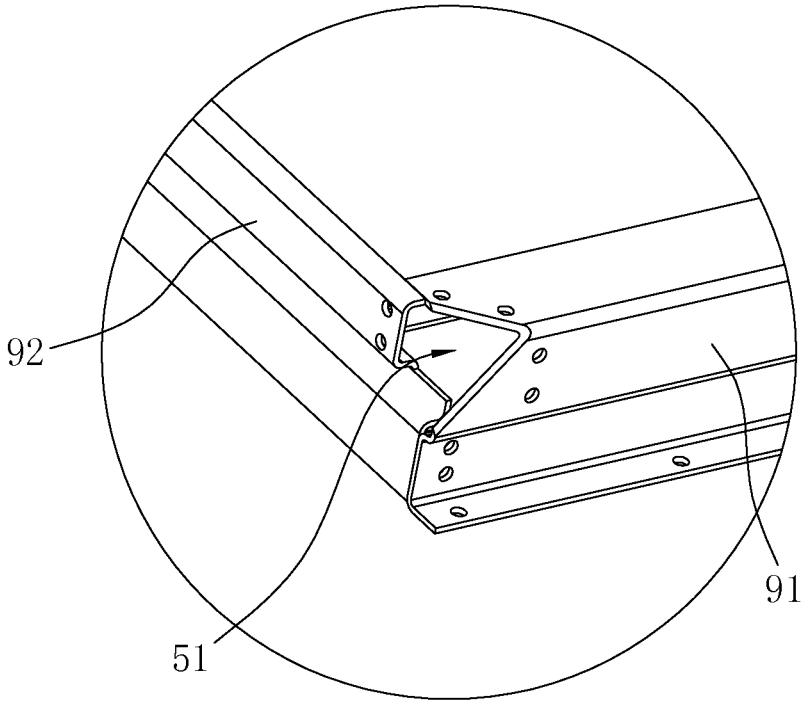
FIG. 14 is an enlarged view of part-II shown in FIG. 12.

FIG. 8 and FIG. 9 respectively are the sectional views of the front column B and the longitudinal crossbeam C both with substantially rectangular cross sections in accordance with the embodiment of the present invention. Besides, the front column B is formed by a fifth component 1" and a sixth component 2" that are nested together into a whole, and the longitudinal crossbeam C is formed by a seventh component 1' and a eighth component 2'" that are nested together into a whole. The section structure and installation method of the front column B and the longitudinal crossbeam C are substantially the same as that of front transverse beam A and the detail is omitted here.

FIG. 10~FIG. 14 are the perspective views of the vehicle carrier (which can be the transversely moving mode and the vertically lifting mode) of the three-dimensional parking garage in accordance with the embodiment of the present invention. The vehicle carrier comprises a bottom frame 8 having a length and composed of a left beam 81, a right beam 82 substantially parallel to the left beam 81 and a bridging beam connecting the left beam 81 and the right beam 82. The bridging beam comprises a front bridging beam 83, a middle bridging beam 84 and a rear bridging beam 85, wherein the front bridging beam 83 has a front side with slope, so that the vehicles can run along the slope when the vehicles enter into the vehicle carrier and exit from the vehicle carrier, making the movement placidly. Both ends of the front bridging beam 83 are connected to the left beam 81 and the right beam 82, both ends of the rear bridging beam 85 are connected to the left beam 81 and the right beam 82, the middle bridging beam 84 is located between the front bridging beam and the rear bridging beam, and both ends of the middle bridging beam 84 are connected to the middle of the left beam 81 and the right beam 82.

A accessorial frame 9 which is disposed along the length of the bottom frame 8 and located in a center of the bottom frame 8, and fixed with the bottom frame 8 by the bolts is in a frame structure, the accessorial frame 9 further comprises two guiding beams 91, a front cross rail 92, and a rear cross rail 93, the front cross rail 92 and the rear cross rail 93 connecting two guiding beams 91.

Furthermore, a plurality of intermediate cross rails 94 are placed between the front cross rail 92 and the rear cross rail 93, connecting the two guiding beams 91, and both two guiding beams 21 are respectively provided with a recess 911 with a size matching the width of the middle bridging beam 84 located at the corresponding place of the middle bridging beam 84, the ends the middle bridging beam 84 are respectively positioned in the recesses 911, so that the bottom of the accessorial frame 9 is able to be flush with the bottom of the bottom frame 1.

A first vehicle plate 31, with a left side and right side, is placed between the accessorial frame 9 and the left beam 81, and a second vehicle plate 32, with a left side and a right side, is placed between the accessorial frame 9 and the right beam 82, each of the left beam and the right beam has a first inner wall and a second inner wall, the left side of the first vehicle plate 31 is perpendicularly mounted to the first inner wall of the left beam 81, the right side of the first vehicle plate 31 is mounted to the accessorial frame 9, while, the right side of the second vehicle plate 32 is perpendicularly mounted to the second inner wall of the right beam 82, the left side of the second vehicle plate 32 is mounted to the accessorial frame 9. Thus, the vehicle plate for parking the vehicles is divided into two parts respectively disposed transversally between the beam and the guiding beam 91 which is relative to the said beam. After the vehicle enters into the vehicle carrier, the tires of the vehicle respectively park on the vehicle plates on both sides of the accessorial frame 9. Because the span length of the vehicle plate is smaller, the thin materials can be used in the same carrying capacity, and the 1.6 mm thick steel can be used directing. So the weight of the vehicle carrier can be abated evidently (compared with the prior art, it can be abated about a quarter), and the cost of the production is significantly lower too.

To prevent the engine oil or dust of the vehicles which park in the vehicle carrier dripping to the inside of the vehicle carrier from the interspace of the accessorial frame 9, a grease baffle 4 is provided on the accessorial frame 9, and the grease baffle 4 has a plurality of grooves 41. The trapeziform groove 41 which can be a whole or scrabbled up from some pieces has the function of accumulating and conducting, and the grease baffle 4 can be cleaned conveniently with the trapeziform groove 41.

To prevent the surface of the tires is damaged by the deams of the bottom frame 8 or the accessorial frame 9 when the vehicles enter into or exit from the vehicle carrier, the front cross rail 92 and two guiding beams 91 forming two joint corners, each joint corner being formed with a first inclined cutting surface and each inclined cutting surface 51 is covered with an inner protecting seal head 52. While one second inclined cutting surface is formed at a front end of each of the left beam 81 and the right beam 82, each second inclined cutting surface is covered with an outer protecting seal head 53.

The structure of the vehicle carrier in accordance with an embodiment of the present invention can be not only applied in the cross sliding vehicle carrier, but also applied in the lift vehicle carrier. Particularly, because of the uneven load and the acceleration of gravity in the lift process of the lift vehicle carrier, the left beam 81 and the right beam 82 will be distorted, while the distortion of the beam will make the body of the vehicle carrier be distorted wholly. To avoid the vehicle carrier being distorted, each of the left beam 81 and right beam 82 of the bottom frame 8 is provided with a first tension mechanism. The first tension mechanism can provide the vehicle carrier with a pretightening force which is just balanced against the pressure that the vehicle carrier gets, thus preventing the distortion of the vehicle carrier.

The first tension mechanism comprises a drawbar 61 along the length of the bottom frame 8, two first supporting pieces 63 mounted on either the left beam 81 or the right beam 82, (the supporting pieces fix on the left beam 81 or the right beam 82 by jointing or bolt) and two tension nuts 62 for positioning the supporting pieces; the drawbar 61 has two ends supported respectively by two supporting pieces 63. Furthermore, each end of each drawbar 61 has thread and is respectively coupled with a tension nut 62 limited in the corresponding supporting pieces 63. Adjust the tension nuts 62 to let the drawbars 61 haunch-up when both ends of the drawbars 61 are pressed and press the supporting pieces 63, thereby making the beam haunch-up. When the vehicles enter into the vehicle carrier, the distortion of the vehicle carrier under the downward stress is just balanced against the upward haunch-up distortion of the beams, thus preventing the distortion of the vehicle carrier.

Taking into account that the front side of the vehicle carrier is distorted badly when the vehicles on the lift vehicle carrier enter into or exit from the vehicle carrier, and to avoid the part distortion of the vehicle carrier and improve the rigidity of the vehicle carrier, a second tension mechanism mounted on the bottom frame 8 is located in the rectangle frame structure which contains the middle bridging beam 84, the front bridging beam 83, the left beam 81 and the right beam 82. The second tension mechanism comprises a first diagonal drawbar 71 secured by two adjusting nuts and mounted between the front bridging beam 83 and the left beam 81 and a second diagonal drawbar 72 secured by two adjusting nuts and mounted between the front bridging beam 83 and the right beam 82. By adjusting the tightness of the adjusting nuts, the pull between the first diagonal drawbar 71 and the second diagonal drawbar 72 can be adjusted, so the beams of the vehicle carrier can produce a certain forced distortion which can be balanced against the distortion of the stressed vehicle carrier, to ensure the local rigidity and the accuracy of form and position, keep the vehicles in a balanced condition during the lifting process, and improve the safety of the operation and the service life of the vehicle carrier.

In the present embodiment, the accessorial frame 9 is disposed in the bottom frame 8, and the vehicle plates are laid between the accessorial frame 9 and the beam. The whole structure which contains the left beam 81, the right beam 82, the assistant beam 9, the bottom beam 8 and the grease baffle 4 not only reduces the span length of the vehicle plate, saves the materials, and reduces the weight and the cost, but also significantly improves the wholly rigidity of the vehicle carrier. Furthermore, the assistant beam 9 itself can also play a role in guiding, so when the vehicles enter into the vehicle carrier, both sides tires of the vehicles go along the guiding beams 91 of the assistant beam 9 to ensure the moving direction of the vehicles, and avoid the vehicles shifting on the parking direction, as well as make the movement convenient when the vehicles exit from the vehicle carrier again, thus make the parking easier and provincial.

The invention claimed is:

1. A three-dimensional parking garage, comprising:

a three-dimensional frame composed of a front traverse beam, a plurality of front columns, a plurality of longitudinal crossbeams, and a plurality of rear columns, each of the front transverse beam, the front columns, and the longitudinal crossbeams is formed by a first component nested with a second component, the first component and the second component having the same shape and size, each of the rear columns is formed by a third component nested with a forth component, the third component and the forth component having the same shape and size; and a plurality of vehicle carriers mounted on the three-dimensional frame, each vehicle carrier comprises a bottom frame having a length and composed of a left beam, a right beam substantially parallel to the left beam and a bridging beam connecting the left beam and the right beam, wherein, each vehicle carrier further comprises an accessorial frame, which is disposed along the length of the bottom frame and located in a center of the bottom frame and parallel to the left beam and the right beam, a first vehicle plate, with a left side and a right side, is placed between the accessorial frame and the left beam, and a second vehicle plate, with a left side and a right side, is placed between the accessorial frame and the right beam, each of the left beam and the right beam has a first inner wall and a second inner wall, the left side of the first vehicle plate is perpendicularly mounted to the first inner wall of the left beam, the right side of the first vehicle plate is mounted to the accessorial frame, while, the right side of the second vehicle plate is perpendicularly mounted to the second inner wall of the right beam, the left side of the second vehicle plate is mounted to the accessorial frame.

2. The parking garage of claim 1, wherein the front transverse beam, the front columns and the longitudinal crossbeam are formed by a rectangular column body with substantially rectangular cross sections, and the rectangular column body comprises the first component and the second component, each component formed through cold rolling with uniform cross sections;

the first component comprises an upper first traverse edge and a lower first traverse edge arranged in parallel, a first vertical edge connecting the upper first traverse edge to the lower first traverse edge, a first inserting edge folding and extending vertically and upwardly from the lower first traverse edge, and a first covering edge folding and extending vertically and downwardly from the upper first traverse edge oppositely to the first inserting edge;

the second component comprises an upper second traverse edge and a lower second traverse edge arranged in parallel, a second vertical edge connecting the upper second traverse edge to the lower second traverse edge, a second inserting edge folding and extending vertically and upwardly from the upper second traverse edge, and a second covering edge folding and extending vertically and downwardly from the lower second traverse edge oppositely to the second inserting edge; and the two first traverse edges of the first component respectively touch one of two second traverse edges of the second component, the first inserting edge touches the inner surface of the second vertical edge of the second component, the first covering edge touches the outer surface of the second vertical edge of the second component, the second inserting edge touches the inner surface of the first vertical edge of the first component, and the second covering edge touches the outer surface of the first vertical edge of the first component.

3. The parking garage of claim 1, wherein each rear column is formed by an I-shaped column body with a hollow-I-shaped cross section, and the I-shaped column body comprises the third component and the forth component, each component formed through cold rolling with uniform cross sections;

the third component comprises an upper third traverse edge and a lower third traverse edge arranged in parallel, a third vertical edge connecting the upper third traverse edge with the lower third traverse edge, a third L-shaped edge folding and extending vertically and outwardly from the third vertical edge and connecting with the upper third traverse edge, a forth L-shaped edge folding and extending vertically and outwardly from the third vertical edge and connecting with the lower third traverse edge, and a third inserting edge folding and extending vertically and upwardly from the lower third traverse edge, a third covering edge folding and extending vertically and downwardly from the upper third traverse edge oppositely to the third inserting edge;

the forth component comprises an upper forth traverse edge and a lower forth traverse edge arranged in parallel, a forth vertical edge connecting the upper forth traverse edge with the lower forth traverse edge, a fifth L-shaped edge folding and extending vertically and outwardly from the forth vertical edge and connecting with the upper forth traverse edge, a sixth L-shaped edge folding and extending vertically and outwardly from the forth vertical edge and connecting with the lower forth traverse edge, and a forth inserting edge folding and extending vertically and downwardly from the upper forth traverse edge, a second covering edge folding and extending vertically and upwardly from the lower forth traverse edge oppositely to the forth inserting edge;

the two third traverse edges of the third component respectively touch one of two forth traverse edges of the forth component, the third inserting edge touches the inner surface of the sixth L-shaped edge, the third covering edge touches the outer surface of the fifth L-shaped edge, the forth inserting edge touches the inner surface of the third L-shaped edge, and the forth covering edge touches the outer surface of the forth L-shaped edge.

4. The parking garage of claim 1, wherein the accessorial frame further comprises two guiding beams, a front cross rail, and a rear cross rail, the front cross rail and the rear cross rail connecting two guiding beams, and a plurality of intermediate cross rails, placed between the front cross rail and the rear cross rail, connecting the two guiding beams.

5. The parking garage of claim 4, wherein the bottom frame comprises a front bridging beam, a middle bridging beam, and a rear bridging beam; the front bridging beam has a front side with a slope and two ends connected to the left beam and the right beam, both ends of the rear bridging beam connected to the rear ends of the left beam and the right beam, the middle bridging beam is located between the front bridging beam and the rear bridging beam, and both ends of the middle bridging beam are connected to the middle of the left beam and the right beam; each guiding beam is provided with a recess for engaging the middle bridging beam.

6. The parking garage of claim 4, wherein the front cross rail and two guiding beams forming two joint corners, each joint corner being formed with a first inclined cutting surface and each inclined cutting surface is covered with an inner protecting seal head.

7. The parking garage of claim 1, wherein a grease baffle is provided on the accessorial frame, and the grease baffle has a plurality of grooves.

8. The parking garage of claim 7, wherein one second inclined cutting surface is formed at a front end of each of the left beam and the right beam, each second inclined cutting surface is covered with an outer protecting seal head.

* * * * *